United States Patent [19]

Allred

[11] 4,084,640

[45] Apr. 18, 1978

[54] COMBINED COMBUSTION FOR IN-SITU RETORTING OF OIL SHALES

[75] Inventor: Victor Dean Allred, Littleton, Colo.

[73] Assignee: Marathon Oil Company, Findlay, Ohio

[21] Appl. No.: 738,928

[22] Filed: Nov. 4, 1976

[51] Int. Cl.[2] ..... E21B 43/24; E21B 43/26

[52] U.S. Cl. ..... 166/259

[58] Field of Search ..... 166/256–262

[56] References Cited

U.S. PATENT DOCUMENTS

| | | | |
|---|---|---|---|
| 2,793,696 | 5/1957 | Morse | 166/256 |
| 2,917,296 | 12/1959 | Prentiss | 166/259 |
| 3,126,955 | 3/1964 | Trantham et al. | 166/256 |
| 3,223,158 | 12/1965 | Baker | 166/259 |
| 3,233,668 | 2/1966 | Hamilton et al. | 166/259 |
| 3,513,913 | 5/1970 | Bruist | 166/259 |
| 3,545,544 | 12/1970 | Peacock | 166/256 |
| 3,586,377 | 6/1971 | Ellington | 166/259 |
| 4,015,664 | 4/1977 | Acheson et al. | 166/259 |

*Primary Examiner*—James A. Leppink
*Attorney, Agent, or Firm*—Joseph C. Herring; Jack L. Hummel

[57] ABSTRACT

Shale oil is recovered from oil shale formations by rubblizing or otherwise fracturing the formation establishing zones for an oxidizing gas injection and off gas and product recovery, igniting the formation at a point intermediate between the injection and recovery zones which is the first phase of the process causing a heat front to move cocurrent and a combustion front countercurrent to the injected gas stream, followed by a second process phase which occurs when the combustion front reaches the zone of oxidant injection and reverses itself oxidizing the residual organic matter laid down on the retorted shale and supplying additional heat to continue the heat front movement to the product recovery zone and completing the retorting of the shale downstream from the ignition zone while recovering heat from the retorted shale in the form of gas preheat.

8 Claims, 4 Drawing Figures

COMBINED COMBUSTION FOR IN-SITU RETORTING OF OIL SHALES

BACKGROUND OF THE INVENTION

1. Field of the Invention

The present invention is directed to an improved in-situ retorting method wherein cocurrent and countercurrent techniques are combined in such a way as to retort the shale in a nonoxidizing atmosphere, achieve some in situ cracking which upgrades the quality of the recovered oils, and also improve the thermal efficiencies in the entire recovery system by recovery of most of the sensible heat from the retorted shales.

2. Description of the Prior Art

Two in-situ combustion processes have been proposed for recovering hydrocarbons from oil shale, the forward or cocurrent process and the reverse or countercurrent process. In cocurrent processes such as that described in U.S. Pat. No. 2,780,449 to Pelzer, the combustion front moves cocurrently, i.e. in the same direction as the oxidant flow. Cocurrent processes conserve heat energy because the injected air stream is preheated as it passes over the burned-out zone cooling the retorted shale and thereby recovering the sensible heat in an effective countercurrent heat exchange process. The preheated oxidant stream combines with the fuel left on the shale, i.e. carbonaceous residue on the shale and oil not yet completely educed from within the particles to provide the heat energy required to preheat the shale and free the shale oil in advance of the combustion zone. Shale oil, hydrocarbon vapors and products of combustion are driven ahead of the heat front and cool as they pass over the shale.

A disadvantage of the cocurrent process is that the combustion front will not move until all of the fuel at the front has been consumed. Therefore, it is desirable to supply only the proper amount of oxygen to burn the carbonaceous residue in the path of the advancing front while not burning recoverable hydrocarbon. The retorting rate is limited and is grossly influenced by the particle size of the rubblized shale. Furthermore, the high pour point waxy oils which such processes tend to produce cool to the ambient formation temperature in advance of the heat front fluid and can reduce gas permeability substantially.

To overcome these disadvantages, the reverse or countercurrent process has been proposed wherein the advancing combustion front (or oxidation zone) moves in a direction countercurrent to that of the injected air stream. As pointed out in Chemical Engineering Process Symposium Series, Volume 61, Number 54 (1965) by Allred and Nielson, this process is characterized by little or no preheating of the injected air stream, and the heat is retained behind the advancing combustion front. On the other hand, the process is such that the combustion zone movement is dependent primarily on the upstream heat transfer and not the total fuel available. Large particles of oil shale can, therefore, be effectively processed since they soak in a hot oxidant depleted gas stream at retorting temperature behind the combustion zone. Naturally, the retorted oil shale remains at or near retorting temperatures when the combustion front passes it. For this reason, the countercurrent combustion process does not make the most efficient use of the available heat. This process also tends to consume light hydrocarbons distilled from the oil shale rather than the carbonaceous residue on the shale. However, as is pointed out in U.S. Pat. No. 2,793,696 to Morse, elevated temperatures behind the advancing countercurrent heat front do provide natural cracking conditions in the burned-out zone through which the hydrocarbon vapors must pass. In the production of shale oil these natural cracking conditions produce hydrocarbons which are already visbroken and partially upgraded into lighter fractions. Because of elevated formation temperatures no condensation or subsequent loss of gas permeability takes place.

The present invention combines cocurrent and countercurrent techniques to retort the shale in a nonoxidizing atmosphere, achieve some in-situ cracking which upgrades the quality of the recovered oils, and improve thermal efficiency by recovering most of the sensible heat from the retorted shale.

SUMMARY OF THE INVENTION

In-situ combustion for the recovery of shale oil from oil shale formations can be effectively accomplished using a process in which retorting is carried out in a rubblized or fractured formation by initiating the combustion in an intermediate zone between the oxidant injection and the production facies of the formation.

Under these conditions a combustion zone will move through the formation toward the point of oxidant injection so long as the temperature is high enough to cause spontaneous ignition and fuel is available to support combustion. Concurrently the hot oxygen depleted gas stream will move downstream forming a heat front (hot zone) into the production side of the ignition zone preheating the shale to retorting temperatures and forming a second shale oil producing zone. Upon reaching the oxidant injection zone the combustion zone will reverse itself and burn back through the formation toward the production point consuming all of the fuel remaining on the formation as is typical of cocurrent combustion and also supplying the additional heat required to complete the downstream retorting.

Initiation of a combustion zone at an intermediate point in the shale formation being processed gives the most desirable combination of the previously discussed cocurrent and counter-current combustion process. That is:

1. The oily matter being educed from the shale is produced in a hot nonoxidizing gas stream over a prolonged period of time so that the larger blocks of shale can be completely retorted.

2. Cracking of the oil takes place to produce a lighter gravity, lower pour point oil which will not plug the formation as it passes beyond the downstream retorting zone.

3. The fuel of the carbonaceous residue and sensible heat of the retorted shales are all effectively utilized.

This process can be better understood from detailed descriptions to follow and by reference to the accompanying drawings.

DETAILED DESCRIPTION OF THE DRAWINGS

Figure 1:
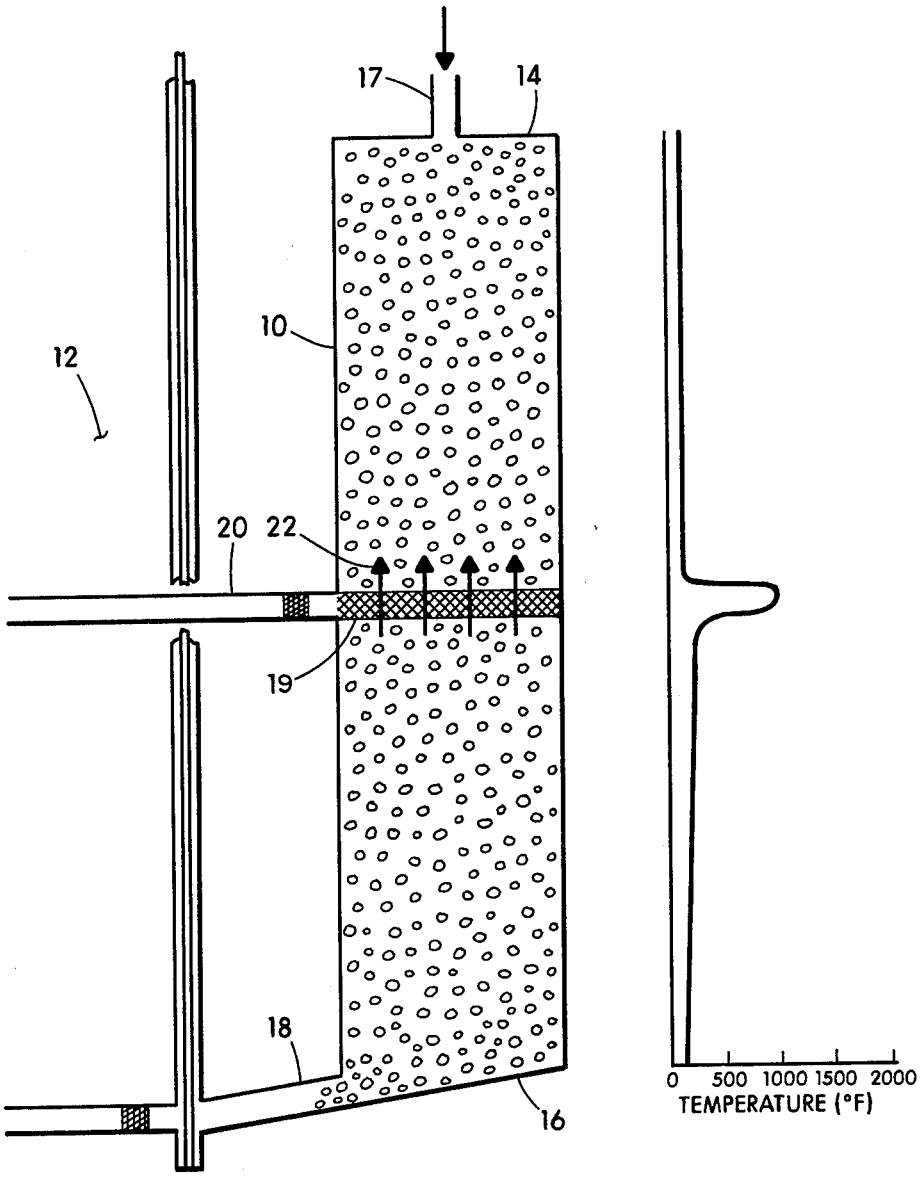
FIG. 1 is a diagrammatic view of the ignition step of this process in an underground verticle rubble chimney, together with a temperature profile taken along the chimney and correlated in position next to it on the drawing.

Referring to the drawings and particularly to FIG. 1 thereof, a vertical rubble chimney 10 is shown in an oil shale formation 12. The chimney is located between an upper facies 14 and a lower facies 16. Upper conduit 17 is an input shaft, while the lower conduit 18 is a producing shaft from which the educed shale oil and other fluids are recovered. Ignition is accomplished in chimney 10, at point 19. After ignition is accomplished, by torch or injection of heated gases, air or other oxidants are introduced through the conduit 17 to promote an upward countercurrent flow of combustion front 22. Condensing, separating and storage equipment, now shown, will be connected to the conduit 18 to recieve the educed shale oil. The ignition profile correlated next to rubble chimney shows a retorting temperature of about 1,000° to 1,300° F.

Figure 2:
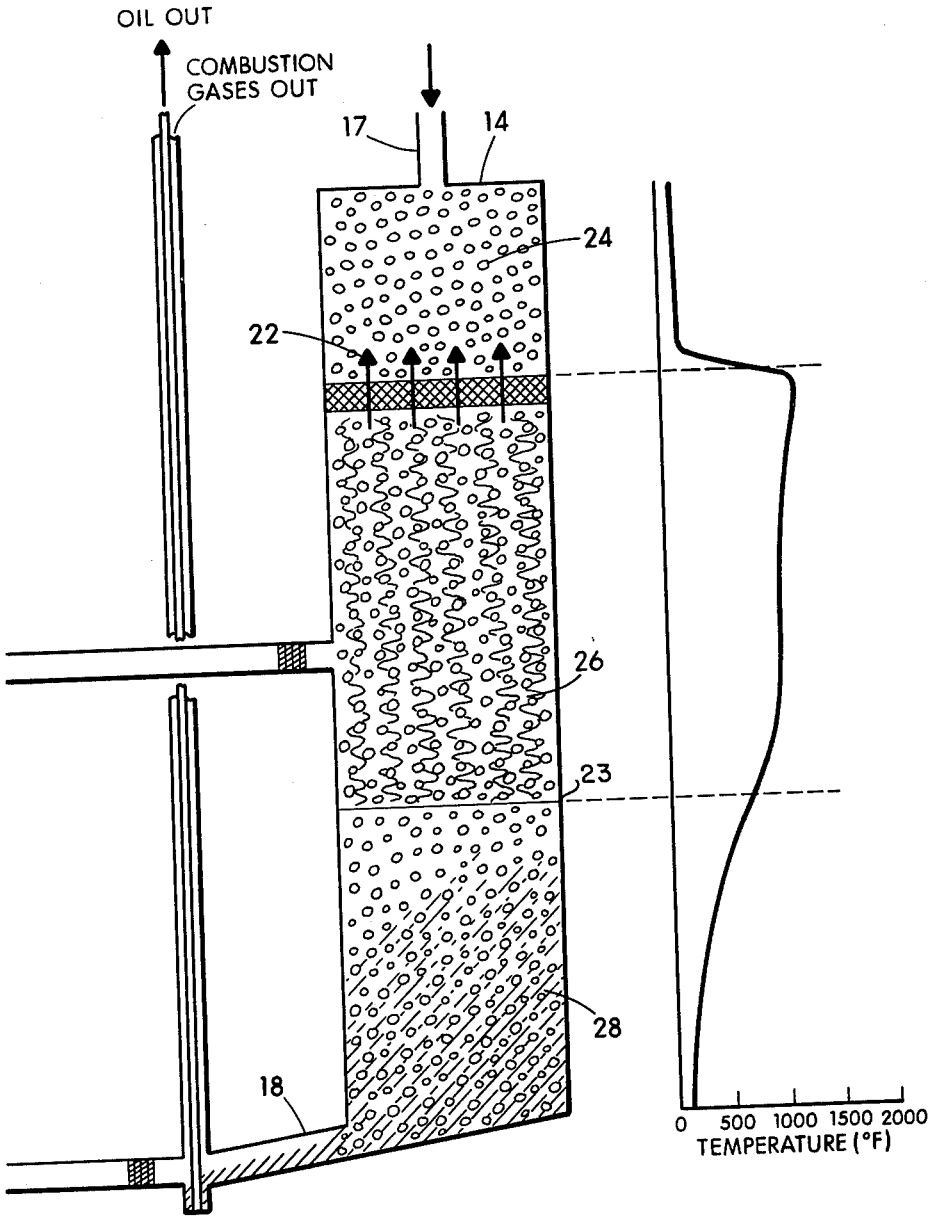
FIG. 2 is a diagrammatic view of the countercurrent combustion step, showing the upward movement of the combustion front 22 and downward movement of the heat front 23 and the products together with the countercurrent's process temperature profile in its correlated position.

FIG. 2 shows combustion front 22 moving upward toward facies 14 and indicates that the unretorted shale zone 24 above the combustion front 22 is receiving heat which is conducted ahead of the combustion front 22 which causes ignition and the heat front 22 to move countercurrent to the injected gas stream. Heat is given up to both the shale in the unretorted shale zone and to the incoming oxidant containing gas from the conduit 17.

The shale in the hot retorted shale zone 26 has yielded most of its hydrocarbon and the shale oil from the upper zone has been subjected to the cracking conditions indicated in the temperature profile for this zone. The shale in hot retorted shale zone 26 still contains some heavier hydrocarbons, some of which may be driven out by the subsequent cocurrent combustion step. Residual carbon deposits will act as the fuel for the cocurrent combustion step. Shale oil condensing zone 28 contains unretorted shale plus shale oil educed from the retorting zone 26. The temperature profile indicates that the shale oil condensing zone 28 is receiving heat from the downcoming hydrocarbons and products of combustion.

Figure 3:
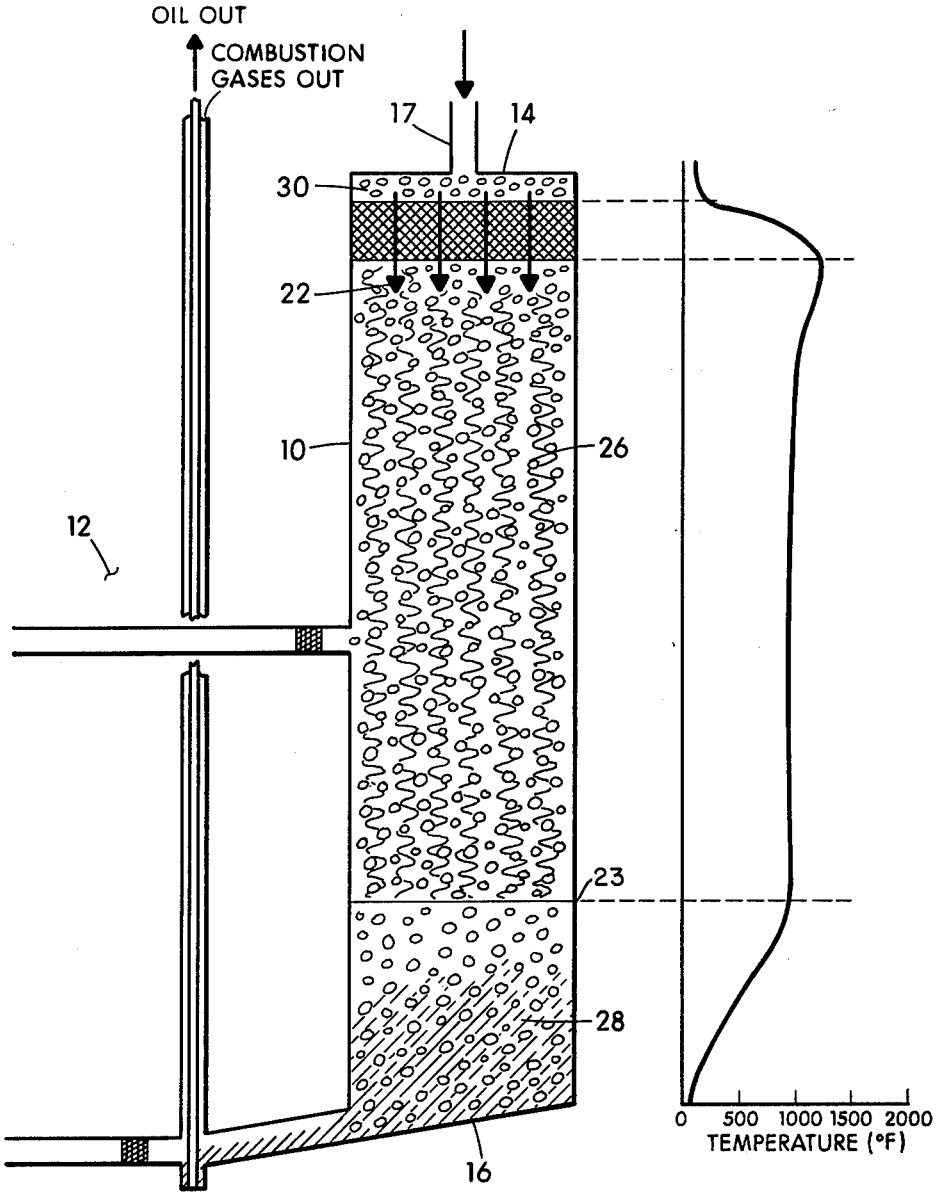
FIGS. 3 and 4 are diagrammatic views of the cocurrent combustion step, showing the downward movement of the combustion front and downward movement of products driven ahead of the combustion front together with the countercurrent process temperature profile in its correlated positions.

FIG. 3 shows combustion front 22 at the point where the countercurrent combustion phase is completed and the cocurrent combustion phase begins through the continued introduction of the now concurrently flowing oxidant through the conduit 17. As the combustion front 22 moves back down the hot retort shale zone 26, it uses as fuel the coked carbon left on the shale during the countercurrent phase and leaves behind a spent shale zone 30. Only small amounts of heavier hydrocarbons remain in zone 26 for education by countercurrent combustion until combustion front 22 travels down to the unretorted shale and shale oil zone 28.

Figure 4:
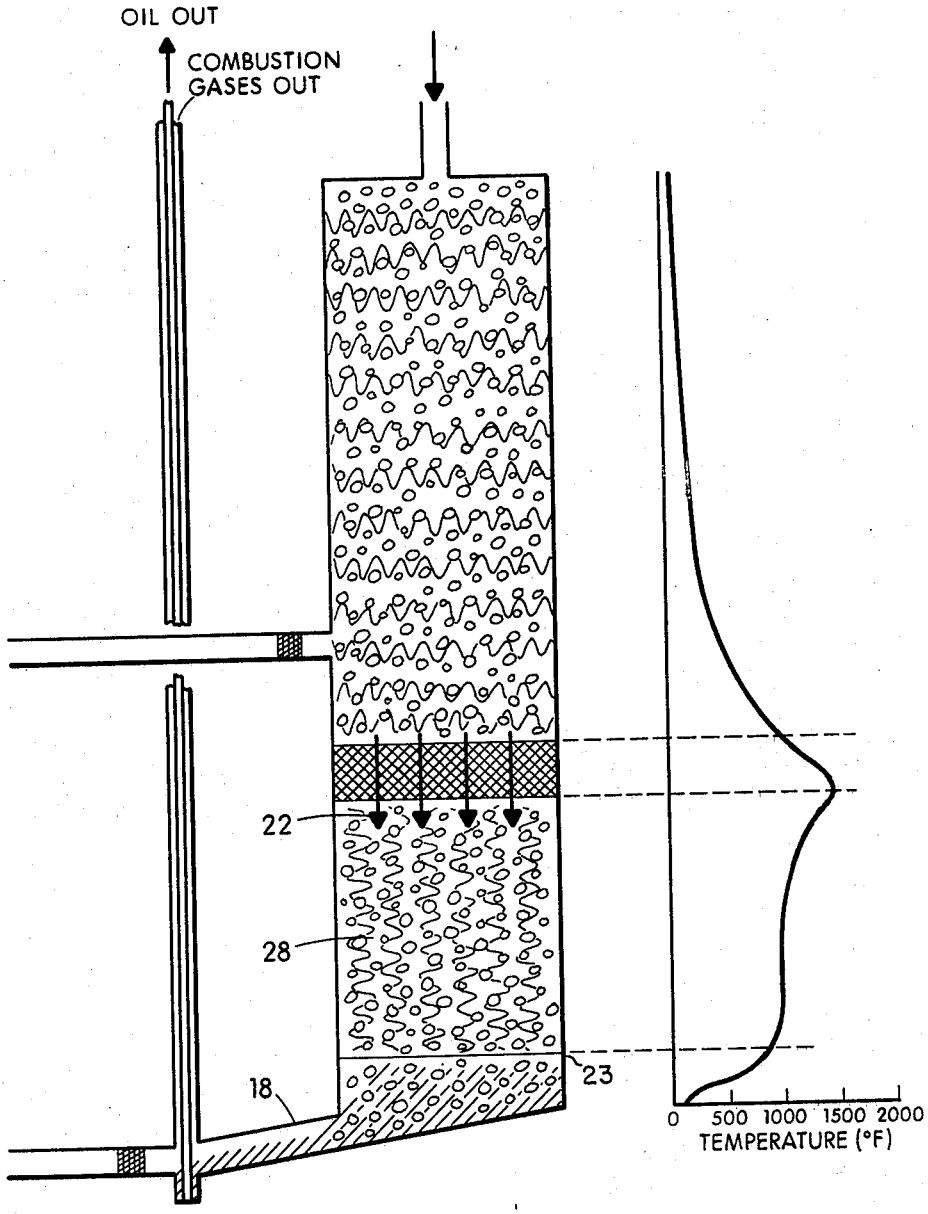

FIG. 4 shows cocurrently driven combustion front 22 reaching the unretorted shale and shale oil zone 28 where the last of the recoverable hydrocarbons are driven out of zone 28 ahead of descending combustion front 22 through conduit 18 to complete the process.

MODE OF OPERATION OF INVENTION

Conduits 17 and 18 may be formed by any suitable means such as by mining or by conventional rotary drilling. Although either conduit and the retort may be directionally drilled, as by methods taught in U.S. Pat. No. 3,223,158 to Baker, it is preferred that the conduits and retort be vertical. The process is also applicable to horizontal processes in the thinner oil shale formations such as that of the Green River Basin of Wyoming.

The rubblizing step may be practiced by conventional fracturing means. Any suitable fracturing means can be used, such as conventional or atomic explosives or hydraulic pressure.

After rubbling, chimney 10 is ignited as shown by the arrangement of FIG. 1. Combustion can be initiated through a third conduit 15, adit, or through known adaptations in the lower conduit 18. Gases such as propane can be used to bring the ignited section 22 to a combustion supporting temperature, by combustion with air or other free oxygen containing gas. Other auxiliary means may be utilized for establishing the combustion front 22 in the permeable oil bearing rubble chimney 10 above the ignition point 18. For example, the temperature of the air injected through the upper conduit may be elevated before injection so as to facilitate the heating of the formation as an aid in combustion or cooled to control the chimney temperature where such action is necessary. Preferably, ignition is started in about the middle two-thirds of the distance between the injection and producting facies and more preferably near the mid-point between the lower ends of the upper facie 14 and lower facie 16.

As a general rule, the ignition point should be placed far enough below facie 14 that the combustion produced from the heat front 22 is recaptured in zone 26. Likewise, the heat given off by the descending oil will be given up to the shale in condensing zone 28 as the oil vapors condense. Exact location of the ignition point will depend upon the organic distribution in the shale and will have to be determined for the particular formations being processed.

Oxidant used herein includes gases having free oxygen or other chemically reactive gases in various proportions and combinations with combustible and noncombustible gases. FIG. 2 shows that as the combustion front 22 begins to move countercurrently toward facie 14, the temperature of the shale above the heat front rises from 750° to 10000° F. Most preferably the temperature in shale zone 26 should be from 850° to 900° F. Heat conducted and radiated ahead of the combustion front 22 countercurrent to the oxidant raises the surface of the shale to its ignition temperature and ignition occurs. Once ignition takes place, the surface temperature rises rapidly, conducting heat into the shale particle. This rapidly increases the rate at which organic matter is evolved from the surface. This organic matter in turn oxidizes at an increasing rate which further increases the temperature of the shale upstream above its ignition point. By this mechanism, oxygen is efficiently depleted from the gas stream. The result is that the only organic matter consumed is that required to keep the temperature sufficiently high to keep the process going.

By careful control of the rate oxygen is added to the system, a very effective temperature control can be achieved. As a result, for the most part, the passage of combustion front 22 through the shale leaves a majority of the organic matter untouched, and oil and gases are pyrolized and distilled out at a controllable retorting temperature. Temperature does fall off as the heat of vaporization for the oil is taken up, but by adjusting the combustion temperature, the oil can be treated at a retorting temperature for whatever period of time it is left in the retort. As indicated in FIG. 2's temperature profile, the oil in zone 26 is subjected to temperatures in the 750° to 1000° F. range, and more preferably in the 850° to 900° F. range, with the result that in-situ cracking or viscosity breaking takes place.

As shown by FIGS. 3 and 4, the cocurrent phase of this process is characterized by considerable preheat of the combustion supporting oxidant and shale. The temperature profiles of cocurrent phase show a well defined temperature rise leading up to the leading edge of the heat front. A comparison of the temperature profile of FIG. 4 with the profiles shown in the previously cited Chemical Engineering Progress Symposium article by Allred and Nielson shows that the falling away of the temperatures in zones 28 and 32 is not as rapid as it would have been had not zones 28 and 32 been previously heated by the vapors descending from the previous countercurrent combustion step. This temperature distribution is such that the thermal efficiencies are improved and the educed oils driven below the descending cocurrent combustion front 22 are mixed with the visbroken oils from the countercurrent phase of the process greatly improving their mobility, a condition which they would not encounter in an isolated cocurrent process.

The foregoing is illustrative only and other means and techniques can be employed without departing from the true scope of the invention defined in the following claims.

What is claimed is:

1. A method of recovering shale oil from an underground oil shale formation comprising the steps of:

(a) rubblizing a zone and forming an oxidant injection means and shale oil recovery means in an oil shale formation, (b) igniting the rubblized zone substantially across the entire zone at an intermediate point between the ends of the zone to create a combustion front in the rubblized zone, (c) injecting an oxidant containing gas into rubblized zone to move a combustion heat front progressively toward the oxidant injection means while driving a heat front and educed hydrocarbon behind the combustion front, established substantially across the entire rubblized zone, toward a recovery means, (d) continuing to inject the oxident containing gas through the rubblized zone after the combustion front reaches the injection means so that the combustion front reverses itself and progressivly moves back toward the recovery means driving the educed hydrocarbons and the heat front progressively toward the recovery means, and (e) removing the educed hydrocarbons from the recovery means.

2. The method of claim 1 wherein the ignition step begins in the middle half of the rubble chimney.

3. The method of claim 1 wherein the ignition step begins near the middle of the rubblized zone.

4. The method of claim 1 wherein the temperature of the rotorted shale zone to the rear of the heat front is held substantially near the temperature of the heat front so that in-situ cracking of the educed hydrocarbon takes place before recovery of said hydrocarbon.

5. The method of claim 4 wherein the temperature of the retorted shale zone to the rear of the heat front is held between 750° and 1000° F.

6. The method of claim 5 wherein the temperature is between 850° and 900° F.

7. The method of claim 1 wherein the rubblized zone is vertical.

8. The method of claim 7 wherein the oxidant is injected into the upper end of the retort and educed hydrocarbons are removed from the lower end.

* * * * *

UNITED STATES PATENT OFFICE

CERTIFICATE OF CORRECTION

Patent No. 4,084,640 Dated April 18, 1978

Inventor(s) Victor Dean Allred

It is certified that error appears in the above-identified patent and that said Letters Patent are hereby corrected as shown below:

| | |
|---|---|
| Column 3, line 22 | Delete "now" and insert --not-- |
| Column 3, line 24 | Delete "recieve" and insert --receive-- |
| Column 4, line 31 | Delete "producting" and insert --producing-- |

CLAIMS

| | |
|---|---|
| Column 6, line 15 | Delete "oxident" and insert --oxidant-- |
| Column 6, line 29 | Delete "rotorted" and insert --retorted-- |

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*